United States Patent [19]

Price

[11] 4,214,923

[45] Jul. 29, 1980

[54] METHOD FOR TREATING METAL

[75] Inventor: Robert J. Price, Peoria, Ill.

[73] Assignee: Caterpillar Tractor Co., Peoria, Ill.

[21] Appl. No.: 948,371

[22] Filed: Oct. 4, 1978

[51] Int. Cl.[2] ..... C23C 38/00

[52] U.S. Cl. ..... 148/12 R; 29/421 R; 72/56

[58] Field of Search ..... 72/56; 29/421 R; 52/731; 148/12 R

[56] References Cited

U.S. PATENT DOCUMENTS

| | | | |
|---|---|---|---|
| 3,447,230 | 6/1969 | Bargainnier | 29/421 X |
| 3,623,204 | 11/1971 | Wagle | 29/421X |
| 3,882,654 | 5/1975 | Yancey | 52/731 X |
| 3,955,266 | 5/1976 | Honami et al. | 29/421 R |

*Primary Examiner*—Leon Gilden

*Attorney, Agent, or Firm*—William B. Heming

[57] ABSTRACT

An element (12) having a chamber (28) such as, for example, a boom (12) of an excavator (10) or a draft tube of a scraper is subject to torsional loading during use of the element (12). Torsional loading creates tensile stresses (T) on the welds (22) of the excavator boom (12), which can lead to weld failure. A method for controllably treating the metal of the element (12) includes heating the element (12) and pressurizing the chamber (28), maintaining the element (12) and chamber (28) at a preselected temperature and pressure ($P_1$), respectively, and cooling the element (12) and depressurizing the chamber (28). The method produces residual compressive stresses ($C_2$) in the metal, such as in the root area (23) of the welds (22) of the excavator boom (12), for increasing fatigue life under torsional loading of the boom (12).

9 Claims, 5 Drawing Figures

FIG. 3
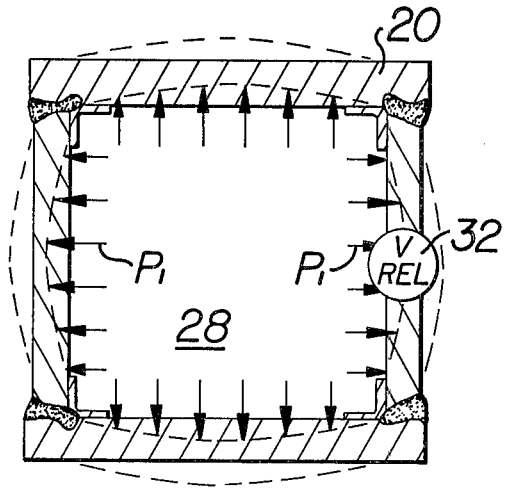
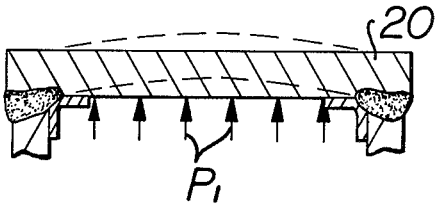
FIG. 4
FIG. 5
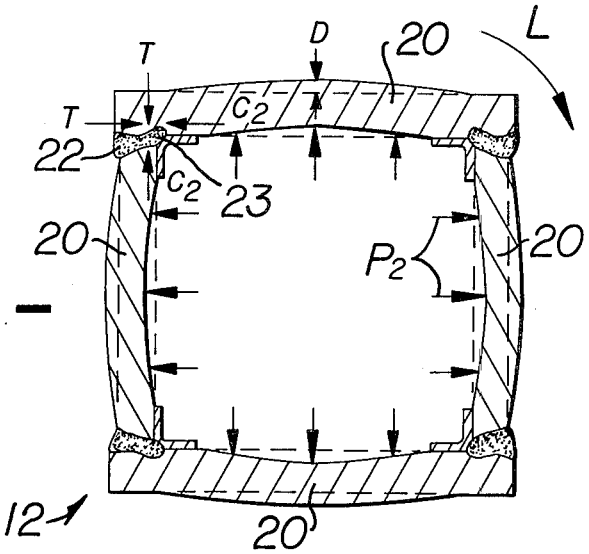

METHOD FOR TREATING METAL

TECHNICAL FIELD

The invention relates to a method including heating an element and pressurizing a chamber of the element for producing residual compressive stresses in metal of the element following cooling of the element and depressurizing the chamber. More particularly, the invention relates to heating the element and pressurizing the chamber to preselected values, maintaining the element and chamber at a preselected pressure and temperature, respectively, and controllably cooling the element and depressurizing the chamber.

BACKGROUND ART

In the use of an element having a chamber, it is desirable to produce residual compressive stresses in metal of the element for reducing the effects of tensile stresses on the element during use of said element. The invention relates to a method for treating the metal of the element in order to produce desirable compressive stresses in the metal of the element for increasing fatigue life under loading of said element.

For example, a boom of an excavator is generally a welded box beam structure having an interior chamber. The box beam structure is constructed of four side walls each welded one to the other with fillet welds or butt welds at the corners of the structure. Such a boom construction is disclosed, for example, in U.S. Pat. No. 3,882,654 which issued to Yancey on May 13, 1975.

During use of the excavator, loads are engaged and carried by a bucket or shovel implement. A result is to place the boom of the excavator under torsional loading. Continual torsional loading, especially under harsh operating conditions, can result in fatigue cracks in the boom structure and subsequent failure of the boom. The resultant necessary replacement of the boom represents a considerable expense of time, labor, and material.

Torsional loading creates tensile loads at the weld roots which can eventually lead to fatigue cracks in roots of the welds of the boom. Placing the welds under residual compressive stresses tends to counter the effect of subsequent tensile stresses at the same location. The boom can then withstand a higher number of torsional loadings without fatigue cracks appearing.

Therefore, it is desirable to provide a method for treating the metal of an element having a chamber in order to produce residual compressive stresses in the metal of the element for increasing fatigue life of said element which is subjected to tensile stresses.

DISCLOSURE OF INVENTION

In one aspect of the present invention, a method for controllably treating metal of an element having a chamber includes heating said element and pressurizing said chamber to preselected values, maintaining the element at a preselected temperature and the chamber at a preselected pressure for a preselected period and controllably cooling said element and depressurizing said chamber.

The element is, for example, a boom of an excavator or a draft tube of a scraper. Under torsional loading of the excavator boom, for example, tensile stresses are produced in the root areas of the welds of the boom. Such tensile stresses can lead to fatigue cracks in said welds. The subject method treats the metal of the boom by creating residual compressive stresses in the root areas of the welds. The compressive stresses tend to counter the effects of the tensile stresses and increase the fatigue life of the welds and the boom.

BRIEF DESCRIPTION OF THE DRAWINGS

FIG. 3 is a diagrammatic cross-sectional view similar to FIG. 2 and showing the boom during treatment with one embodiment of the present method;

FIG. 4 is a diagrammatic cross-sectional view of one portion of the boom of FIG. 3; and FIG. 5 is a diagrammatic cross-sectional view similar to FIG. 2 showing in exaggerated detail the configuration of the boom following treatment with said embodiment of the present method and under conditions as might be encountered during use of said boom.

BEST MODE FOR CARRYING OUT THE INVENTION

Figure 1:
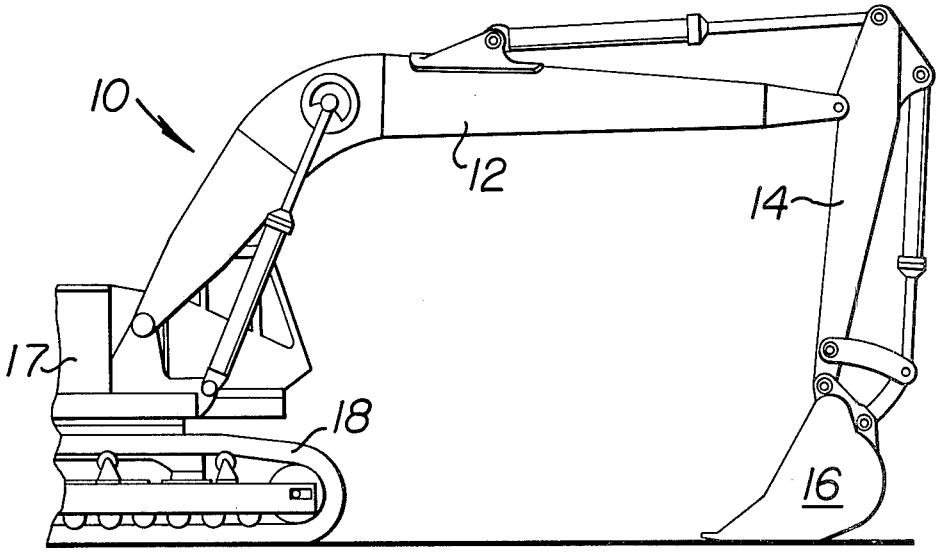
FIG. 1 is a diagrammatic side view of an excavator having a boom which represents one embodiment of an element upon which the method of the present invention is to be performed.
Figure 2:
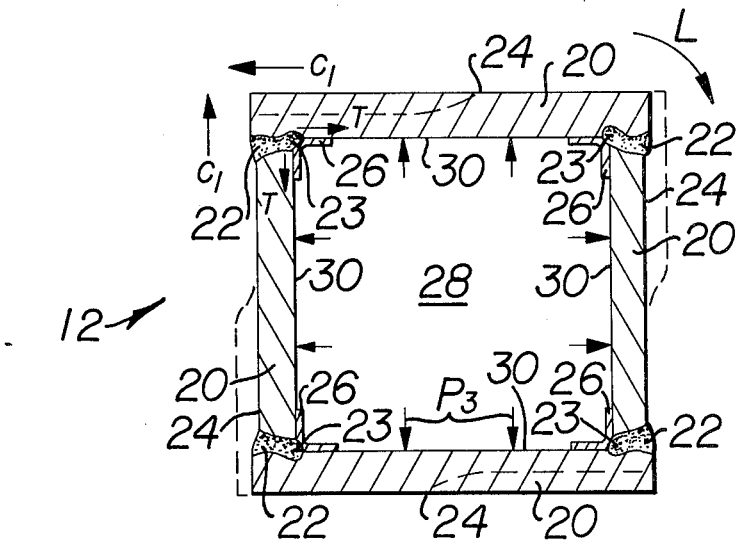
FIG. 2 is a diagrammatic cross-sectional view of the boom of FIG. 1 showing the boom in enlarged detail and under conditions as might be encountered during use of said boom.

Referring to FIG. 1, an excavator 10 has a boom 12, stick 14 and bucket 16. The bucket 16 is positionable relative to material to be engaged by swinging the upper portion 17 of the excavator 10 about the undercarriage 18 and moving the boom 12 and stick 14 to various positions. The boom 12 is welded structure constructed of a metal and having a box beam configuration, as is shown in FIG. 2. Said boom 12 has four sidewalls 20 welded one to the other at intersecting edges of said sidewalls 20. Welds 22 extend from the outer surface 24 of the sidewalls 20 to L-shaped angle bars 26. The welds 22 have root areas 23 adjacent said angle bars 26. Said boom 12 forms a closed chamber 28 defined by the inner surfaces 30 of the sidewalls 20.

In a method for treating metal of an element 12 having a chamber 28, said element 12 is, for example, the boom 12 of the excavator 10. The metal particularly desired to be treated is the root areas 23 of the welds 22. The method includes heating the boom 12 and pressuring the chamber 28 to preselected values of temperature and pressure, respectively. The method further includes maintaining said boom 12 at a preselected temperature and the chamber 28 at a preselected pressure $P_1$ for a preselected period and controllably cooling said boom 12 and depressurizing said chamber 28. Said method is useable to produce residual compressive stresses $C_2$ in the boom 12 for countering tensile stresses T encountered in said boom 12 from, for example, torsional loading L (FIG. 2).

It is desirable that the method include the step of controllably passing fluid from the chamber 28 for maintaining said chamber 28 at the preselected pressure $P_1$. As is shown in FIG. 3, a pressure relief valve 32 is provided for performing said step. The fluid can be a gas or liquid.

In performing the steps of heating the boom 12 and pressurizing the chamber 28, the boom 12 is preferably heated to a preselected temperature prior to pressurizing the chamber 28. The result is a better regulation of the chamber pressure because of the increase in pressure of the fluid initially in the said chamber 28 owing to thermal expansion during heating. The chamber 28 can also be pressurized to a preselected pressure prior to heating the boom 12. Such pressure is dependent upon the temperature at which the boom 12 is treated, owing to the thermal expansion of the fluid in the chamber 28 during heating of said boom 12. Additionally, it may be desirable in certain instances to pressurize the chamber 28 immediately prior to controllably cooling the boom 12. Pressurization at this point may limit maximum deflection of the metal of the boom 12 owing to a somewhat higher yield strength of said metal following temperatures attained for stress relieving purposes.

The pressure to which said chamber 28 is pressurized is preferably of a magnitude sufficient for said pressure to permanently deform the metal to be treated. In this case, it is desirable to treat the root areas 23 of the welds 22. In other words, therefore, the root areas 23 are stressed beyond the elastic limit of the metal in said root areas 23, resulting in a permanent deformation thereof following cooling of the boom 12. As is shown in exaggerated outline in FIG. 3, pressurizing the chamber 28 results in expanding or deforming the sidewalls 20 of the boom 12. It is desirable that stresses on portions of the boom 12 not immediately adjacent the root areas 23 be limited to within or near the elastic limit of the metal in said portions in order to minimize subsequent permanent deformations in said portions.

It is desirable that the values of temperature and pressure $P_1$ at which the boom 12 and chamber 28 are maintained, respectively, be substantially equal to the values to which said boom 12 and chamber 28 are heated and pressurized, respectively (FIG. 3). In some instances, however, it may be desirable to vary said temperatures and pressures. The pressure $P_1$ at which said chamber 28 is maintained is of a magnitude sufficient for said pressure $P_1$ to permanently deform the root areas 23 of the welds 22. The preselected period for which the boom 12 and chamber 28 are maintained at the temperature and pressure $P_1$, respectively, is of a duration sufficient for stress relieving the boom 12 at said temperature and pressure $P_1$. Said preselected period is dependent upon the rate at which the residual stresses, greater in magnitude than the yield strength of metal in the boom 12 at said temperature, are removed through localized yielding in the metal. Such stress relieving processes involving heating a metal are well known in the metallurgical art.

Following the above mentioned step of stress relieving the boom 12, said boom 12 is controllably cooled and the chamber 28 is controllably depressurized. The boom 12 is cooled to a preselected temperature prior to depressurizing the chamber 28. Said preselected temperature will normally be the ambient temperature in order to avoid stress concentrations resulting from cooling of the boom 12 subsequent to depressurization of the chamber 28 and the tendency of the boom 12 to return toward its normal dimensions. The boom 12 is preferably cooled at a preselected rate. Said rate is dependent upon uniform cooling of the boom 12 in order to avoid stress concentrations in the structure resulting from cold spots in the metal.

The chamber 28 is depressurized to a preselected pressure $P_2$ (FIG. 5). It is desirable that the chamber 28 be depressurized at a preselected rate. Said rate being dependent upon the formation of undesirable stress concentrations in the metal of the boom 12 resulting from a too rapid reduction of the expanded or deformed boom 12 subsequent to depressurization. The pressure P2 in the chamber 28 following depressurization is preferably the same as the pressure $P_3$ in the chamber 28 prior to the heating of the boom 12 and pressurizing of the chamber 28.

It will be evident to those skilled in the art that the depressurization of the chamber 28 subsequent to stress relieving the boom 12 will create residual compressive stresses in the metal of the areas of the boom 12 which were subject to stresses greater in magnitude than the elastic limit of said metal. The residual compressive stresses are created owing to the tendency of the stress relieved metal of the boom 12 in the expanded or deformed state to return to the original configuration of said metal prior to implementation of the present method.

It should be understood that the present method is not limited to the steps and order of steps herein discussed so long as the pressure at which said chamber 28 is maintained is present at a minimum preselected temperature sufficient for a predetermined level of stress relief of the boom 12.

INDUSTRIAL APPLICABILITY

In the use of the method, the boom 12 and chamber 28 are heated and pressurized to preselected values and maintained at a preselected temperature and pressure, respectively. Pressurization of the chamber 28 provides stresses greater than the elastic limit of metal in selected areas of the boom 12 tending to expand or deform said areas. Applying an elevated temperature to the boom 12 stress relieves said boom 12 in the pressure deformed configuration. The boom 12 and chamber 28 are controllably cooled and depressurized, respectively, in order to create residual compressive stresses $C_2$ in the selected areas resulting from the tendency of the boom 12 to reduce to its dimensions prior to heating and pressurization. The residual compressive stresses $C_2$ tend to substantially overcome problems such as fatique cracking associated with tensile stresses T produced in said selected areas during loading L of the boom 12.

For example, the bucket 16 of the excavator 10 is used to engage and move material loads. In operations involving said bucket 16, torsional loads are commonly applied on the boom 12. The torsional loading L results in deformation of the boom 12, as is shown exaggerated in outline in FIG. 2. The welds 22 experience tensile and compressive stresses $T, C_1$ under the torsional loading L. The tensile stresses T are primarily exerted in the root areas 23 and often result in fatique cracking in said root areas 23. To reduce the effect of such stresses, booms are generally stress relieved. The process involves heating the booms in an oven and slowly cooling said booms after soaking at a preselected temperature for a certain period in the oven, as is well known in the metallurgical art.

The present method is herein directed to creating residual compressive stresses $C_2$ in the root areas 23 of the welds 22 for countering said tensile stresses T. The magnitude of the compressive stresses $C_2$ considered to be beneficial depends upon the loading encountered, the structural resistance of the boom 12 to the loading and the effects of the method upon the boom 12, as will hereinafter be more fully discussed.

The boom 12 is controllably deformed by pressurizing the chamber 28 in order to provide permanent deformation of the root areas 23 for creating the beneficial compressive stresses $C_2$. Each sidewall 20 of the boom 12 may be represented as a uniformly loaded beam having fixed ends, as is shown in FIG. 4. It will be evident to those skilled in the art that for such a beam the bending moments and shear forces are greatest at the corners of the beam. This indicates that the general areas of the welds 22, which represent the corners of each sidewall 20, will tend to experience the maximum stresses involved in pressurizing the chamber 28 and will tend to be the initial portions of the boom 12 to permanently deform. The weakness of the areas of the welds 22 relative to the sidewalls 20 further promotes this condition. The areas of the welds 22 thus experience tensile and compressive stresses at the pressure $P_1$ at which the chamber 28 is maintained during the preselected or stress relief period.

It is assumed in the present example that the boom 12 is constructed of steel having a modulus of elasticity of about $30\times10^6$ psi at 20° C. (70° F.) and is heated to a temperature of about 615° C. (1150° F.) for stress relief purposes. Air at atmospheric pressure $P_3$ of 14.7 psi is initially present in the chamber 28 (FIG. 2). Assuming a negligible volume change owing to pressure induced deflection in the boom 12, the pressure in the chamber 28 owing to thermal expansion during the stress relief process can be easily calculated by one skilled in the art to be about 30 psi. Other fluids such as oil or water can also be used to pressurize the chamber 28.

The approximate magnitude of the compressive stresses created in the root areas 23 of the welds 22 at said stress relief pressure can also be easily calculated by one skilled in the art. Said compressive stress, $C_2$, can be calculated from the following:

$$S=(M\times t/2)/I$$

where M is equal to the bending moment at the corners of a fixed end, uniformly loaded beam or $(P\times W^2)/12$ (W is equal to the width of the sidewall assumed to be 26 inches, I is equal to moment of inertia or $t^3/12$ and t is the thickness of the sidewall 20 assumed to be 0.6 inches, P is equal to the pressure owing to thermal expansion during stress relief). The value for stress calculated from the above is about 28,000 psi.

If the minimum yield stress of the steel material of the boom 12 is assumed to be about 45,000 psi, the above calculated residual compressive stress $C_2$ is reasonably significant for improving the fatique life of the root areas 23. Therefore, pressure in the chamber 28 owing only to thermal expansion during stress relief is of sufficient magnitude in this example to be used as the pressure $P_1$ maintained in the chamber 28 during the stress relief or preselected period. An outside pressure supply source, such as a compressor, can be used to provide higher chamber pressures where greater residual stresses are desired. As is shown in FIG. 3, the pressure relief valve 32 is used to regulate the maximum pressure in the chamber 28 during the stress relief process.

The pressure $P_1$ in the chamber 28 during the stress relief process results in a permanent deflection in the boom 12 (shown exaggerated in FIG. 5). Permanent deflection resulting from applying the present method to an element such as the boom 12, limits the magnitude of residual stresses which can be created owing to tolerances in the dimensions of the element or boom 12.

The maximum permanent deflection D, occurring substantially at the center of each sidewall 20 of the boom 12, can be easily calculated by one skilled in the art. If maximum permanent deflection is calculated as the difference between the maximum deflections in the sidewall 20 at 1150° F. and at 70° F. from the pressure $P_1$ of 30 psi, said maximum permanent deflection D in the above example is about 0.08 inches. Said value assumes that the modulus of elasticity of the steel in the boom 12 is about $12\times10^6$ psi at 1150° F.

In the above mentioned manner, the boom 12 is treated during the stress relief process of controlled heating and cooling to create residual compressive stresses $C_2$ in the root areas 23 of the welds 22 of the boom 12. Fatigue cracking in said root areas 23 owing to the tensile stresses T under loading L is substantially overcome by the presence of said compressive stresses $C_2$ (FIG. %). It will be understood by those skilled in the art that the present method will also produce residual tensile stresses adjacent the welds 22. Such stresses will tend to counter the effects of the compressive stresses $C_1$ produced on the boom 12 during loading L.

Other aspects, objects and advantages will become apparent from a study of the specification, drawings and appended claims.

I claim:

1. A method for controllably treating metal of a preselected area (23) of an element (12) having a chamber (28), sidewalls (20) and welds (22) each having a root area (23) and each joining respective sidewalls (20) on to the other, said preselected area (23) being defined by said root areas (23) of said welds (22), comprising:

heating said element (12) and pressurizing said chamber (28) to preselecting values;

controllably stressing the metal of said preselected area (23) of the element (12) beyond the elastic limit of said metal maintaining said chamber (28) at a preselected pressure ($P_1$) for a preselected period;

controllably stress relieving said element (12) by maintaining said element (12) at a preselected temperature while said metal of the preselected area (B) is stressed beyond the elastic limit of said metal; and controllably creating residual stresses in said preselected area (23) of the element (12) by controllably cooling said element (12) and depressurizing said chamber (28).

2. The method, as set forth in claim 1, including the step of controllably passing fluid from the chamber (28) for maintaining said chamber (28) at the preselected pressure ($P_1$).

3. The method, as set forth in claim 1, wherein the chamber (28) is pressurized to a preselected pressure prior to heating the element (12).

4. The method, as set forth in claim 1, wherein the element (12) is heated to a preselected temperature prior to pressurizing the chamber (28).

5. The method, as set forth in claim 1, wherein the pressure to which said chamber (28) is pressurized is of a magnitude sufficient for stressing the metal of said preselected area (23) of the element (12) beyond the elastic limit of said metal.

6. The method, as set forth in claim 1, wherein the element (12) is cooled to a preselected temperature prior to depressurizing the chamber (28).

7. The method, as set forth in claim 1, wherein the element (12) is cooled at a preselected rate.

8. The method, as set forth in claim 1, wherein the chamber (28) is depressurized to a preselected pressure ($P_2$).

9. The method, as set forth in claim 1, wherein the chamber (28) is depressurized at a preselected rate.

* * * * *

Disclaimer 4,214,923.—*Robert J. Price,* Peoria, Ill. METHOD FOR TREATING METAL. Patent dated July 29, 1980. Disclaimer filed Apr. 30, 1981, by the assignee, *Caterpillar Tractor Co.*

Hereby enters this disclaimer to claims 1-9 of said patent.

[*Official Gazette July 14, 1981.*]